US006533383B1

(12) United States Patent
Saruta et al.

(10) Patent No.: US 6,533,383 B1
(45) Date of Patent: Mar. 18, 2003

(54) INK JET TYPE PRINTING APPARATUS INK CARTRIDGE THEREFOR AND METHOD OF CONTROLLING THE PRINTING APPARATUS

(75) Inventors: Toshihisa Saruta, Suwa (JP); Satoshi Shinada, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/438,356

(22) Filed: Nov. 12, 1999

(30) Foreign Application Priority Data

| | | |
|---|---|---|
| Nov. 11, 1998 | (JP) | 10-320577 |
| Aug. 23, 1999 | (JP) | 11-235246 |
| Oct. 22, 1999 | (JP) | 11-301447 |

(51) Int. Cl.[7] ..... B41J 2/235
(52) U.S. Cl. ..... 347/19; 347/23
(58) Field of Search ..... 347/19, 23; 358/1.14

(56) References Cited

U.S. PATENT DOCUMENTS

| | | | | |
|---|---|---|---|---|
| 5,049,898 A | | 9/1991 | Arhtur et al. | 346/1.1 |
| 5,428,378 A | * | 6/1995 | Murata et al. | 347/19 |
| 5,572,242 A | * | 11/1996 | Fujii et al. | 347/23 |
| 5,610,635 A | * | 3/1997 | Murray et al. | 347/19 |
| 5,699,091 A | * | 12/1997 | Bullock et al. | 347/19 |
| 5,788,388 A | * | 8/1998 | Cowger et al. | 347/19 |
| 5,813,022 A | * | 9/1998 | Ramsey et al. | 711/3 |
| 5,835,107 A | * | 11/1998 | Suzuki et al. | 347/19 |
| 5,854,885 A | * | 12/1998 | Abe | 358/1.14 |
| 5,942,043 A | * | 8/1999 | Suemune | 347/23 |
| 6,286,928 B1 | * | 9/2001 | Kasamatsu | 347/23 |

FOREIGN PATENT DOCUMENTS

| | | | |
|---|---|---|---|
| EP | 0 593 282 A2 | 4/1994 | B41J/2/175 |
| EP | 0 720 916 A2 | 7/1996 | B41J/2/175 |
| EP | 0 789 322 A2 | 8/1997 | G06K/15/00 |
| EP | 0 854 043 A2 | 7/1998 | B41J/2/175 |
| EP | 0 854 044 A2 | 7/1998 | B41J/2/175 |
| EP | 0 873 873 A2 | 10/1998 | B41J/2/175 |
| JP | 62-184856 | 8/1987 | B41J/3/04 |
| JP | 6-126981 | 5/1994 | B41J/2/175 |
| JP | 8-238824 | 9/1996 | B41J/29/38 |
| JP | 2594912 | 12/1996 | B41J/2/175 |
| JP | 10-202914 | 8/1998 | B41J/2/175 |
| WO | 96/05061 | 2/1996 | B41J/2/175 |

* cited by examiner

*Primary Examiner*—John Barlow
*Assistant Examiner*—Julian D. Huffman
(74) *Attorney, Agent, or Firm*—Sughrue Mion, PLLC

(57) ABSTRACT

An ink jet type printing apparatus, including: a print head having nozzle apertures from which ink droplets eject; an ink cartridge containing ink supplied to the print head; a memory device attached to the ink cartridge, the memory device storing information relating to ink contained in the ink cartridge; and an access control device for controlling accesses to the memory device for reading data from and writing data in the memory device, the access control device allowing the access to the memory device only when the print head is in non-printing status.

23 Claims, 13 Drawing Sheets

INK JET TYPE PRINTING APPARATUS INK CARTRIDGE THEREFOR AND METHOD OF CONTROLLING THE PRINTING APPARATUS

The present application claims priority from Japanese Patent Applications Nos. Hei. 10-320577 filed on Nov. 11, 1998, Hei. 11-235246 filed on Aug. 23, 1999 and Hei. 11-301447 filed on Oct. 22, 1999, the contents of which are incorporated herein by reference.

BACKGROUND OF THE INVENTION

1. Field of the Invention

The present invention relates to an ink jet type printing apparatus which is supplied with ink from detachable ink cartridge and ejects ink droplets from a nozzle aperture of a print head to a recording medium, and to an ink cartridge suitably installed in the ink jet type printing apparatus. More particularly, the invention relates to an ink cartridge provided with a memory device for writing and reading information relating to the ink contained therein, to an ink jet type printing apparatus which installs thereon the ink cartridge capable of controlling access to the memory device of the ink cartridge, and to a method of controlling the same.

2. Related Art

Generally, an ink jet type printing apparatus is provided with a print head which supplies drive signals to a piezoelectric transducer or heating means in response to print data, and pressurizes the ink by the energy generated by the piezoelectric transducer or the heating means to thereby eject ink droplets from nozzle apertures, and with an ink cartridge accommodating the ink to be supplied to the print head.

The print quality is determined by the resolution of the print head such as size or diameter of each of the nozzle aperture and the number of the apertures. In addition to the resolution of the print head, the print quality is also influenced by the type, or specification of ink or, for example, viscosity of ink. Further, the print quality is also determined by the bleeding condition of ink ejected on a recording medium. Therefore, the ink characteristics has been improved to enhance the print quality, or the driving operation for the print head has been improved to perform an optimum print quality for the particular ink characteristics even if the printing apparatus installs a conventional type of ink. Furthermore, the head maintenance condition has also been improved with respect, for example, to the cyclic period of the cleaning operation or the flushing operation to prevent the nozzle apertures from clogging.

Thus, the print quality of a printing apparatus can be improved as a whole only when the combination of the ink characteristics with the appropriate driving operation for the print head is improved, not only by the ink characteristics. The result of such technical development can be reflected on newly manufactured ink jet type printing apparatuses before shipping to the marketplace. However, such technical development would be practically impossible after the printing apparatus is shipped, because the printing apparatus has to be brought to a service center, and the memory means which records the control data for the printing apparatus would have to be exchanged.

In view of the difficulties as described above, as disclosed in Japanese Patent Publication No. 2594912, there has been proposed a printing apparatus which employs an ink cartridge provided at a surface thereof with a non-volatile rewritable memory, and data stored in the memory indicating the residual ink is read out by the printing apparatus for controlling the printing operation.

In addition, there has been proposed another process for controlling the print operation of an ink jet type printing apparatus in accordance with information recorded in a memory element disposed on an ink cartridge. For example, published Unexamined Japanese Patent Application (OPI) No. 6-126981 discloses an ink cartridge which is provided with a memory element such as an electrically erasable and programmable read only memory, or EEPROM. The memory element previously stores information relating to the print control, and the printing apparatus reads out information and utilizes it to control printing and also writes data of, for example, residual ink calculated by the printing apparatus.

The conventional printing apparatuses as described above may be operated under an optimum condition by adapting the print control to information relating to the residual ink. However, in a case where a user treats the printing apparatus inappropriately, for example, if the power is shut down roughly without proceeding through a designed power-off process which is not expected by the manufacturer, data of the consumed amount of ink cannot be written in the memory of the ink cartridge, which may result in causing a big difference of residual ink amount according to data stored in the memory element from that of the real ink cartridge. Further, the same problem would occur when an accident happens such as, for example, an inevitable blackout or when the power socket of the printing apparatus is accidentally pulled out of the outlet by entangling user's or other person's feet in the power line.

On the other hand, the conventional printing apparatus may accompany another problem as follows. The rewritable memory means which does not require power for holding the stored data requires longer time for writing data to or reading from the memory means. Therefore, frequent writing and reading data would deteriorate the throughput of the printing operation. Specifically, when data is written in the memory means during a printing operation, a central processing unit of the printing apparatus is given a heavy workload because it has to process both the print control and the data writing control at the same time. In addition, normally the data writing operation is performed after moving the ink cartridge on a carriage to a predetermined position which takes time. Further, in case of employing a non-contact type semiconductor storage means, reading and writing data takes longer time than the other type of the memory means, and the decreased throughput of a non-contact type semiconductor storage means more seriously degrades performance. As a result of the above problems, the conventional printing apparatuses having memory means would raise a problem in much lowering the print speed.

On the other hand, there are generally two different carriage types of ink jet printing apparatus, i.e., an on-carriage type in which an ink cartridge is mounted on a moving carriage provided with a print head on one hand, and an off-carriage type in which an ink cartridge is mounted on a fixed part of the printing apparatus apart from a moving carriage. According to the on-carriage type printing apparatus, since the ink cartridge is located adjacent to the print head the memory device may be affected adversely by noise generated by drive pulse signals when the print head is driven. For example, data may be changed or damaged if the memory device receives the noise while the printing apparatus reads data from or writes data in the memory device. Such a problem is more serious in case of a semiconductor memory device of a non-contact type which employs electro-magnetic signals because the drive signals for the print head would propagate strongly in the air and may be interposed as a noise on the electro-magnetic signals supplied to the memory device.

SUMMARY OF THE INVENTION

The present invention was made in view of the foregoing difficulties and problems accompanying the conventional ink jet type printing apparatus.

An object of the present invention is to provide an ink jet type printing apparatus capable of assuredly writing and reading data relating to ink in and from a memory device attached on an ink cartridge without deteriorating the throughput of the printing speed of the printing apparatus.

Another object of the present invention is to provide a method of controlling an ink jet type printing apparatus to assuredly write and read data relating to ink in and from a memory device attached on an ink cartridge without deteriorating the throughput of the printing speed of the printing apparatus.

Further, it is also an object of the present invention to provide an ink jet type printing apparatus capable of assuredly writing data relating to ink in a memory device of an ink cartridge even if power is shut down suddenly due to an unexpected accident or user's error.

Furthermore, it is an object of the present invention to provide a method of controlling an ink jet type printing apparatus to assuredly write data relating to ink in a memory device of an ink cartridge even if power is shut down suddenly due to an unexpected accident or user's error.

It is still another object of the present invention to protect data to be read or written from or in a memory device attached to an ink cartridge from noise which may be generated when driving a print head.

The above and other objects can be achieved by a provision of an ink jet type printing apparatus which, according to the present invention, includes: a print head having nozzle apertures from which ink droplets eject; an ink cartridge containing ink supplied to the print head; a memory device attached to the ink cartridge, the memory device storing information relating to ink contained in the ink cartridge; and an access control device for controlling access to the memory device for reading data from and writing data in the memory device, the access control device allowing the access to the memory device only when the printing apparatus is in non-printing status.

According to the invention, the non-printing status of the print head may be caused either by a power off instruction signal operated by a user, forcibly shutting down the printing operation, or accidentally or inevitably shutting off a power.

The ink jet type printing apparatus according to the invention may further include an auxiliary battery for supplying power to the apparatus when the accidental or inevitable power shut-off happens.

Further, according to the invention, the memory device may be constituted by either a contact type non-volatile memory, a non-contact type non-volatile rewritable memory, or an electrically rewritable semiconductor storage device.

According to the invention, the memory device is turned off when the print head is driven to perform a printing operation.

In the ink jet type printing apparatus according to the invention, the ink cartridge may include a first ink cartridge containing black ink and a second ink cartridge containing a plurality of different color inks. The memory device may include a first memory device for the first, black ink cartridge and a second memory device for the second, color ink cartridge.

Further, according to the invention, the access control device includes: a read/write section for reading data from and writing date in the memory device; a residual ink amount detection and judgement section for calculating out a ink amount consumed by the print head; and a control section for operating the read/write section to perform a read/write operation, while the printing apparatus is in non-printing status, in accordance with information relating to calculated residual ink receiving from the residual ink amount detection and judgement section. The access control device counts number of the write operation with the memory device, and the memory device is disposed on the ink cartridge at a position adjacent to the print head.

On the other hand, the above and other objects can also be achieved by a provision of a method of accessing a memory device attached to an ink cartridge for storing information relating to ink for use in an ink jet type printing apparatus having a print head. Information is written in or read from the memory device only when the printing apparatus does not drive the print head.

According to the invention, information is read from or written in the memory device after a power off instruction signal is input and before actually turning off a power to the printing apparatus. Further, information read from or written in the memory device either after a printing operation is forcibly shut down, after a power to the printing apparatus is accidentally, inevitably shut down and before the power is actually turned off. According to the invention, the power to the printing apparatus may be supplied from an auxiliary battery after the power is actually turned off.

Still further, the above and other objects can also be achieved by a provision of a method of controlling an ink jet type printing apparatus having a print head and an ink cartridge provided with a memory device for storing information relating to ink, including steps of: turning on a power to the printing apparatus; accessing the memory device and reading out information stored therein; judging whether a head maintenance operation is necessary; proceeding the head maintenance operation if it is judged to be necessary; and accessing the memory device and writing new information therein. The control method according to the invention may further includes steps of: turning on a power to the memory device immediately before the step of accessing the memory device and reading out information; and turning off the power to the memory device immediately after the step of accessing the memory device and writing new information.

According to another aspect of the invention, the above and other objects can also be achieved by a provision of a method of controlling an ink jet type printing apparatus having a print head and an ink cartridge provided with a memory device for storing information relating to ink, including steps of: inputting an instruction replacing the ink cartridge; accessing the memory device of the ink cartridge and writing information in the memory device; moving a carriage on which the print head is mounted to a position where the ink cartridge is to be replaced; taking place the replacement of the ink cartridge; accessing the memory device of an ink cartridge newly installed in the printing apparatus; introducing ink contained in the new ink cartridge to the print head; finishing the ink introduction; and accessing the memory device. The method according the aspect of the invention may further includes steps of: turning on a power to the memory device immediately before each of the steps of accessing the memory device; and turning off the power to the memory device immediately after each of the steps of accessing the memory device.

According to still another aspect of the present invention, a method of controlling an ink jet type printing apparatus having a print head and an ink cartridge provided with a memory device for storing information relating to ink, includes steps of: accidentally or inevitably shutting down a power to the printing apparatus; accessing the memory device of the ink cartridge and writing information in the memory device; and actually turning off the power to the printing apparatus. In this aspect of the invention, the control method may further includes steps of: turning on a power to the memory device immediately before the step of accessing the memory device; and turning off the power to the memory device immediately after each of the steps of accessing the memory device. The control method according to the invention may still further includes steps of supplying a power to the printing apparatus from an auxiliary battery after the step of accidentally or inevitably shutting down a power to the printing apparatus.

According to the invention, data relating to ink such as residual ink is written in and readout of the memory device, which requires a certain time, only when the non-printing status is detected during the printing process. Therefore, the printing operation can be controlled with high reliability in accordance with data stored in the memory device without deteriorating the throughput of the printing speed of the printing apparatus.

Further, according to the invention, data can be written assuredly in the memory device even in a case where a power to the printing apparatus is suddenly shut off without through the designed power-off process by a user who treats the apparatus inappropriately or the power is shut off due to a blackout or when the power socket of the printing apparatus is accidentally pulled out of the outlet by entangling user's or other person's feet in the power line.

Furthermore, since the throughput is not lowered as the memory device is accessible only when the printing apparatus is in a non-printing status, the apparatus can employ even the non-contact type memory device, such as electromagnetic type or opto-magnetic type memory device.

Moreover, because data is written in the memory device only when the printing apparatus is in a non-printing status, i.e., when no drive signal is supplied to the print head, data to be written in the memory device never suffer from the problem of noise which is generated by the drive signals to the print head particularly in case of a on-carriage type printing apparatus in which the memory device attached to the ink cartridge is located adjacent to the print head. Therefore, accurate data can be held in the memory device.

DESCRIPTION OF THE PREFERRED EMBODIMENTS

The preferred embodiments of the present invention will now be described in detail with reference to accompanying drawings.

Figure 1:
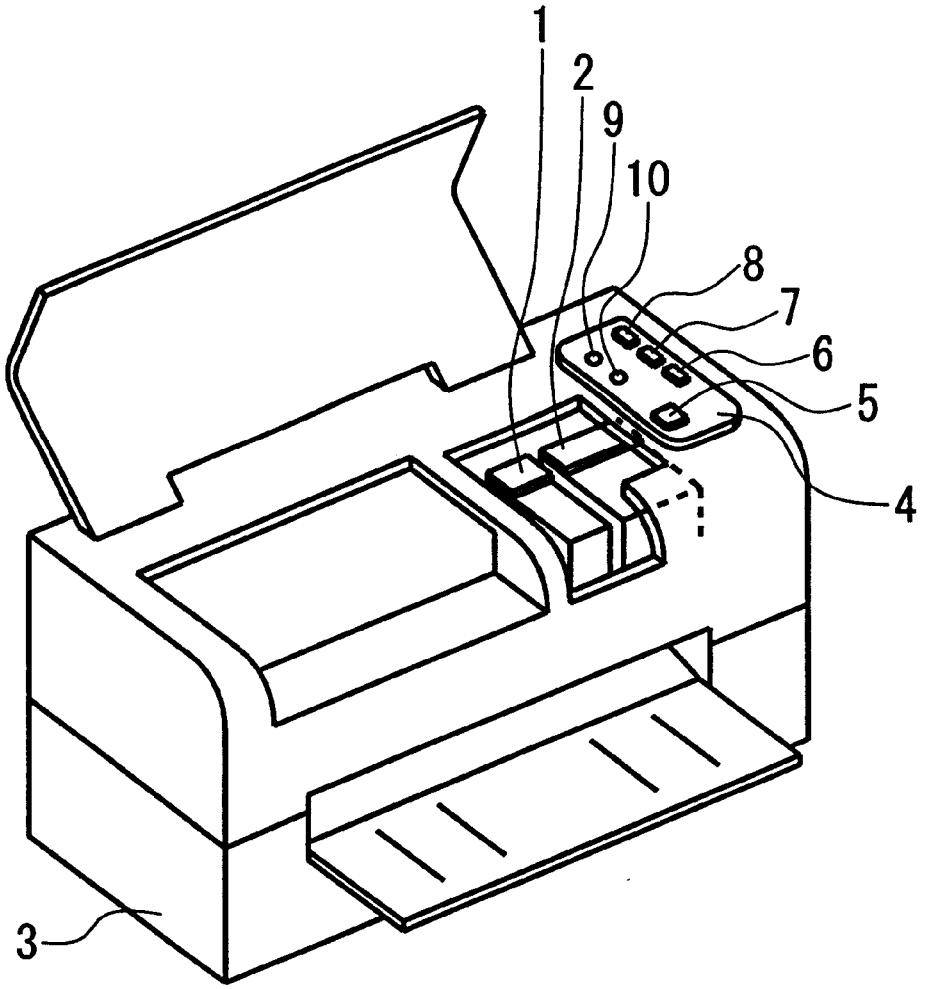
FIG. 1 is a schematic perspective view showing an ink jet type printing apparatus of an on-carriage type according to the first embodiment of the present invention.
Figure 2:
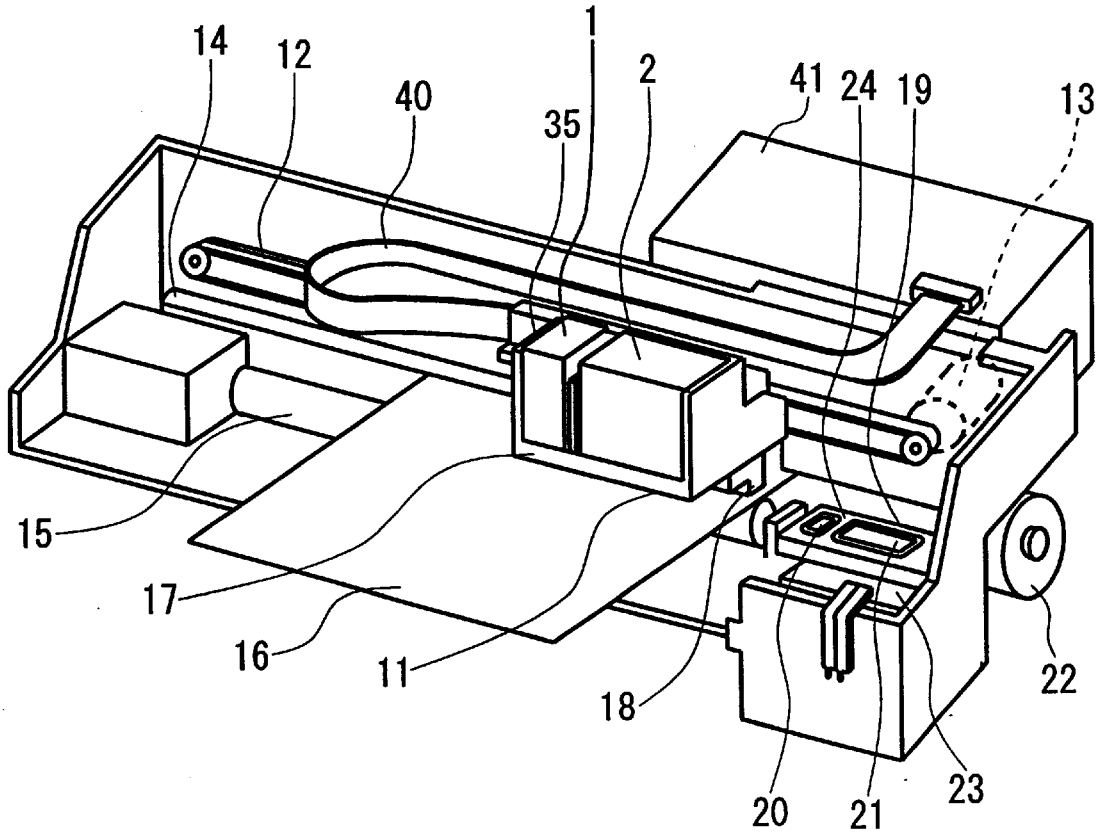
FIG. 2 is a perspective view of the printing mechanism of the printing apparatus shown in FIG. 1.
Figure 3A:
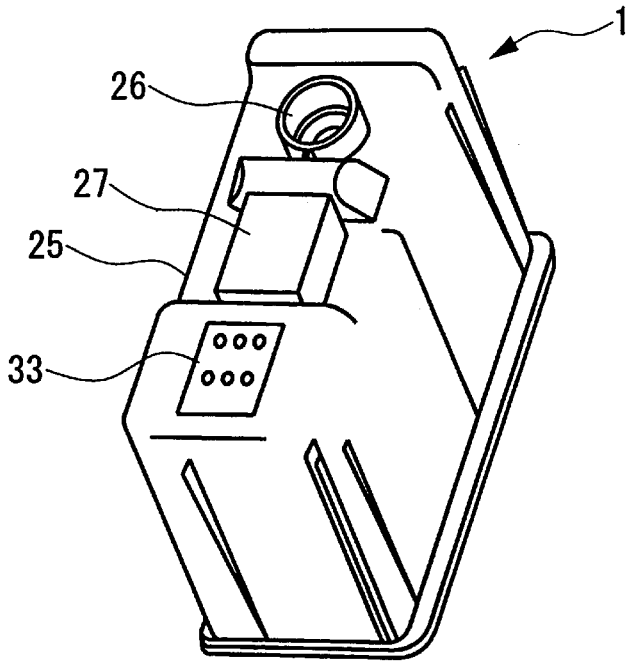
FIG. 3A is a perspective view of a black ink cartridge, which provides ink to print head, mounted on the printing apparatus shown in FIGS. 1 and 2, and FIG. 3B a color ink cartridge.
Figure 3B:
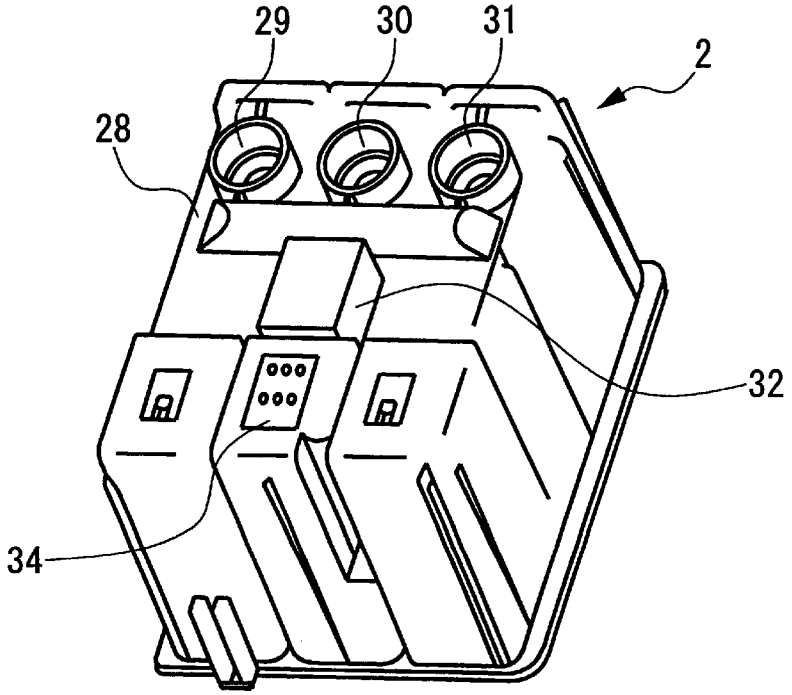
Figure 4:
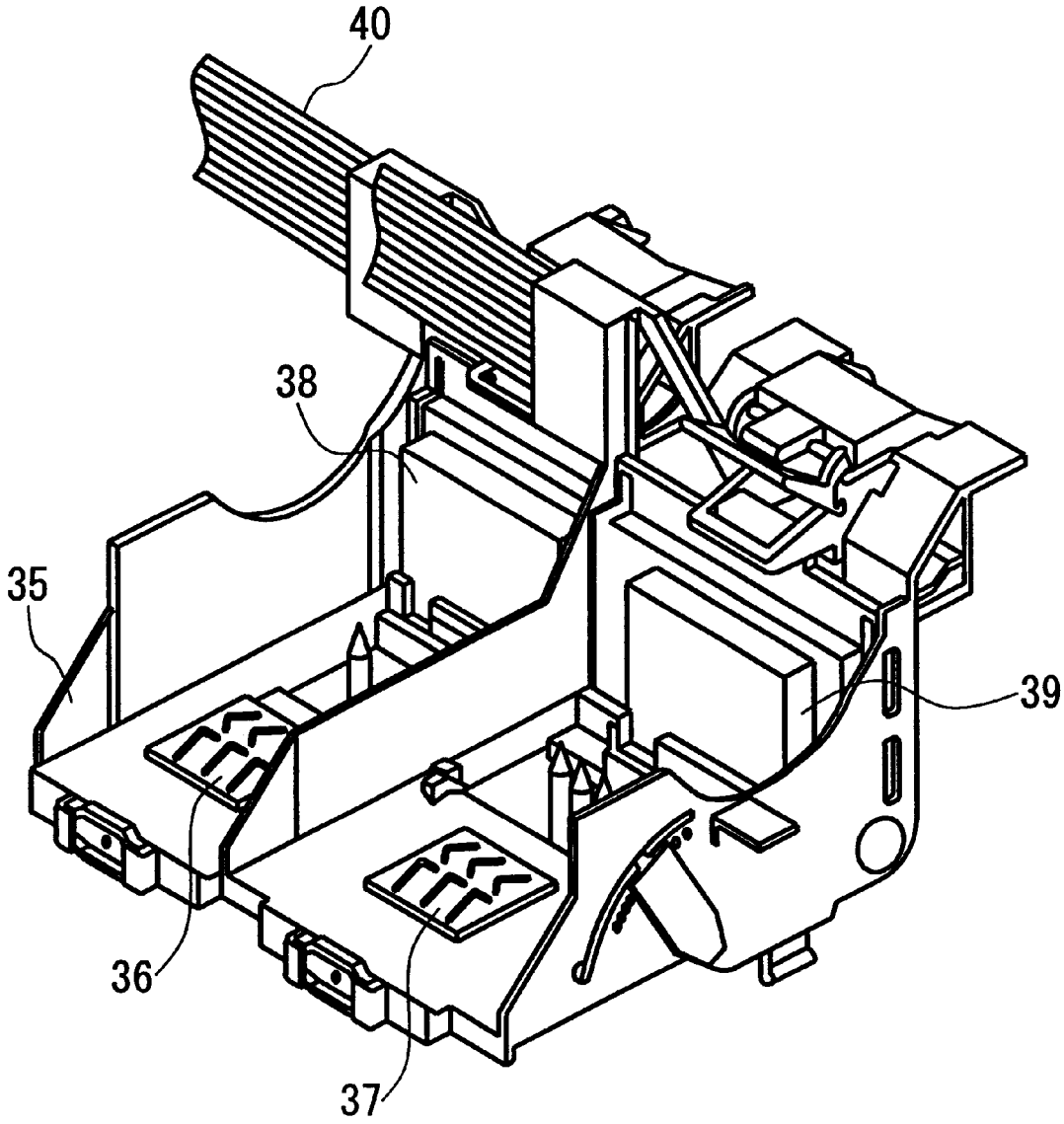
FIG. 4 is a perspective view showing a head holder of the printing apparatus on which the ink cartridges shown in FIGS. 3A and 3B are mounted, according to one embodiment of the present invention.
Figure 5:
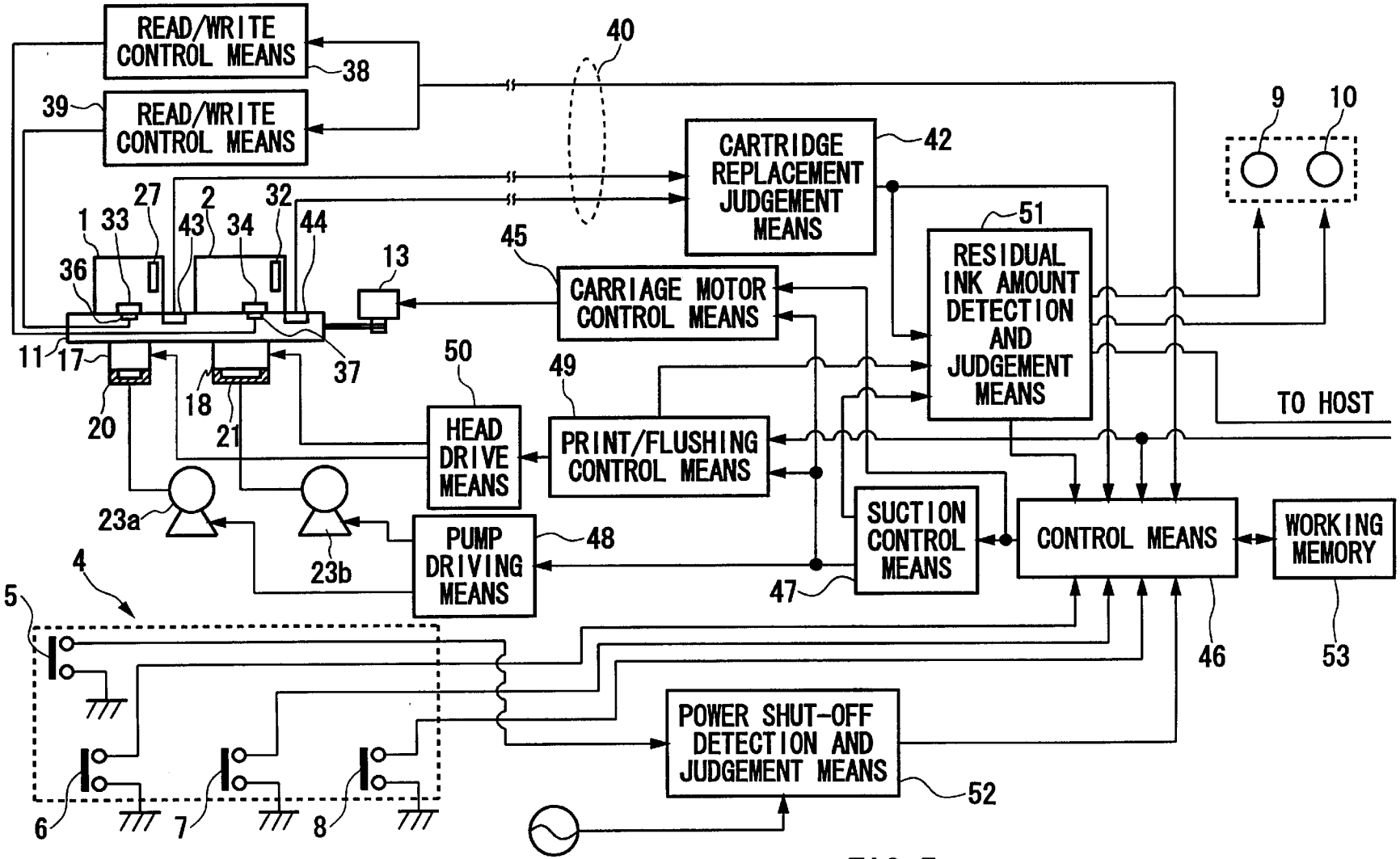
FIG. 5 is a block diagram showing a control mechanism of the ink jet type printing apparatus.

FIGS. 1 through 5 concern a first embodiment of the present invention. Specifically, FIG. 1 is a schematic perspective view showing an ink jet type printing apparatus of an on-carriage type according to the first embodiment of the present invention. FIG. 2 is a perspective view of the printing mechanism of the printing apparatus shown in FIG. 1. FIG. 3A is a perspective view of a black ink cartridge, which provides ink to print head, mounted on the printing apparatus shown in FIGS. 1 and 2, and FIG. 3B a color ink cartridge. FIG. 4 is a perspective view showing a head holder of the printing apparatus on which the ink cartridges shown in FIGS. 3A and 3B are mounted, according to one embodiment of the present invention. FIG. 5 is a block diagram showing a control mechanism of the ink jet type printing apparatus.

FIG. 1 depicts one embodiment of the ink jet type printing apparatus according to the invention which is provided with a housing 3 which accommodates a print mechanism disposed at a printing region described later and two different ink cartridges 1, 2 which respectively contain black ink and color inks positioned at a non-printing region.

In the embodiment shown in FIG. 1, the printing apparatus has an operation panel 4 installed on an upper, exposed surface of the housing 3. The operation panel 4 arranges thereon a power switch 5, an ink cartridge replacement instruction switch 6, a head cleaning instruction switch 7 for black ink, a head cleaning instruction switch 8 for color inks, and ink end status indicators 9 and 10 for the black and color ink cartridges 1 and 2, respectively.

FIG. 2 is a schematic view of a printing mechanism of the ink jet type printing apparatus shown in FIG. 1. As shown in FIG. 2, a carriage 11 connects to a carriage drive motor 13 through a timing belt 12 so that the carriage 11 is driven to reciprocate along a guide member 14 moving back and forth on and in parallel with a platen 15. A print head 17 coupling to the black ink cartridge 1 for ejecting black ink droplets and a different print head 18 coupling to the color ink cartridge 2 for ejecting color ink droplets are mounted on the carriage next to each other, facing a recording medium 16.

As shown in FIG. 2, the printing apparatus further includes a capping unit 19 disposed at a non-printing region (on a right hand side in FIG. 2). The capping unit 19 is provided with a slider 24 mounting thereon a first cap 20 for capping the print head 17 for black ink and a second cap 21 for capping the print head 18 for color inks. Both the caps 20 and 21 connect through tubes to a pump unit 23 of a twin structure type driven by a motor 22. Owing to the structure, during a head cleaning operation in which the print heads 17 and 18 are moved to the non-printing region and capped by the caps 20 and 21, each of the caps 20 and 21 separately receives negative pressure generated by the pump unit 23, thereby to force each of the print heads 17 and 18 to eject ink droplets from all nozzle apertures thereof to recover from clogging occurred in the nozzle apertures.

FIGS. 3A and 3B show one example of the black ink cartridge 1 and the color ink cartridge 2, respectively, to be mounted on the carriage 11 shown in FIG. 2. As shown first in FIG. 3A, the black ink cartridge 1 is formed with an ink supply port 26 for connecting to an ink guide passage of the print head 17 on a bottom surface 25 facing the carriage 11 when the ink cartridge is mounted on the carriage 11. The ink cartridge 1 is also provided at the bottom surface thereof with a semiconductor storage means 27 serving as a memory device which is electrically rewritable memory.

On the other hand, as shown in FIG. 3B, the color ink cartridge 2 has a plurality of ink chambers independent from one another for accommodating a plurality of different color inks. Three ink chambers are provided in the present embodiment. The color ink cartridge 2 is formed at a bottom surface thereof with ink supply ports 29, 30 and 31 communicating with the respective ink chambers and coupling to the ink guide passage of the print head 18. The color ink cartridge 2 is also provided at a bottom surface thereof with a semiconductor storage means 32 serving as a memory device which is electrically rewritable memory.

The semiconductor storage means 27 and 32 store therein information relating to ink, particularly to residual ink. In addition, for example, the storage means store information for enabling appropriate printing such as date code of manufacture, materials for the ink, the number of detachment of the ink cartridge and others.

Preferably, the semiconductor storage means of the same type, same model may be used as the storage means 27 and 32 for both the ink cartridges 1 and 2 having different structure. As shown in FIGS. 3A and 3B, each of the ink cartridges 1 and 2 has contacts 33, 34 which connect to read/write control means 38, 39 through conductive means (not shown) and contacts 36, 37, respectively, disposed on a cartridge holder 35 mounted on the carriage 11 as shown in FIG. 4. Each of the read/write control means 38, 39 connects to a control apparatus 41 of the printing apparatus through a flexible cable 40.

In case of using as the semiconductor storage means 27, 32 an electrically erasable and programmable read only memory, or EEPROM which limits the number of rewrite, the memory should be designed to have a durability such that the rewritable number is more than ten times as many as the maximum number of sheets the ink contained in each of the ink cartridges 1, 2 can print.

FIG. 5 is a block diagram showing one example of the control apparatus 41 according to the present invention shown in FIG. 2. A cartridge replacement judgement means 42 receives signals from switches 43, 44 disposed on the cartridge receiving surface of the carriage 11 and depressed down by the ink cartridges 1, 2, respectively, when the cartridges are mounted on the carriage 11 so that the judgement means 42 detects whether the ink cartridge is mounted on or detached from the carriage 11.

A carriage motor control means 45 operates, under a control of a control means 46, the carriage 11 to reciprocate on the guide member 14 for a printing and also the print heads 17, 18 to move to a position where those heads can be capped for an ejection recovery operation.

A suction control means 47 operates, under a control of the control means 46, the carriage 11 to seal the print heads 17, 18 by the capping unit 19 and operates a pump driving means 48 to control the suction force and suction time for each of suction pumps 23*a*, 23*b* of the pump unit 23, so that. Under the operation, ink is forcibly ejected from both the print heads 17 and 18 for the ink ejection recovery and, in addition, ink from new ink cartridge is filled in the print heads 17, 18 when the ink cartridge is replaced with a new one and the print heads 17, 18 are enabled to perform printing with new ink.

A print/flushing control means 49 activates a head drive means 50 to supply drive signals to each of the print heads 17, 18 thereby to eject ink droplets therefrom for performing a printing. Further, the print/flushing control means 49 operates, when the print heads is located at a flushing region such as the capping position, the head drive means 50 to supply drive signals to the print heads 17, 18 to eject ink from every nozzle apertures to flush the high-viscosity ink coming to remain in the nozzle apertures toward an ink receiver (not shown). Thus, the nozzle apertures of the print heads can be prevented from clogging by the flushing operation.

A residual ink amount detection and judgement means 51 counts and accumulates the number of dots generated during the printing operation, the number of ink droplets ejected by the flushing operation, and the amount of ink consumed by the ink filling operation and the cleaning operation, and calculates out the amount of residual ink in the ink cartridges 1 and 2.

A power shut-off detection and judgement means 52 detects an on/off status of a power switch 5 and outputs a signal representing the status. The power shut-off detection and judgement means 52 actuates a predetermined power-off process when the power is turned off by the power switch 5 and, subsequently, stops supplying the power to the entire printing apparatus.

The control means 46 receives signals from the ink cartridge replacement instruction switch 6, the black and color head cleaning instruction switches 7 and 8 of the operation panel 4, the power shut-off detection and judgement means 52, the residual ink amount detection and judgement means 51 and also from the host computer. The control means 46 controls every operation or process, that is, power-on process, power-off process, cleaning operation, residual ink checking operation, printing operation, ink cartridge replacement operation and the like. Further, the control means 46 transfers to semiconductor storage means 27, 32 data of consumed ink amount in accordance with an output detection signal of the residual ink amount detection and judgement means 51 during the printing apparatus is in non-printing status when, for example, power is turned on or turned off, or when the print heads 17, 18 stops printing operation.

The control means 46 identifies each of the ink cartridges, counts how many times data is written in the memory device of particular cartridge, and writes data in the memory device corresponding to the number of times data is written in the memory device.

The operation of the apparatus constituted above will be described below.

First, when a power is supplied to the apparatus by operating the power switch 6, the control means 46 receives the current date/time codes from the host computer or the like and stores the date/time codes as data in a writable area of the semiconductor storage means 27, 32 of the ink cartridges 1, 2, respectively, in accordance with the format information designed for the storage means.

If the black ink cartridge 1 is new and mounted to the printing apparatus for the first time, the control means 46 operates the carriage motor control means 45 to move the carriage 11 to the capping position. Subsequently, the control means 46 operates the suction control means 47 and the pump drive means 48 to activate the pumps 23*a* to fill ink in the print head 17 supplying the ink from the new ink cartridge 1. The amount of ink exhausted from the ink cartridge 1 during the filling process is calculated by multiplying the suction amount per time unit by the actual time of the operation, and the residual ink amount detection and judgement means 51 stores the calculated amount as data representing a consumed ink amount. The same operation proceeds when the color ink cartridge 2 is new and mounted to the printing apparatus for the first time.

When a predetermined time has passed during a non-printing status where the printing apparatus receives no print instruction signal from the host computer, the control means 46 writes data representing the consumed ink amount stored in the residual ink amount detection and judgement means 51 in the semiconductor storage means 27, 32 of the respective ink cartridges 1, 2.

On the other hand, after finishing the ink filling process for the print heads 17, 18 and the apparatus receives a print instruction signal, the print heads 17, 18 starts performing a printing operation under a control of the control means 46. During the printing operation, the residual ink amount detection and judgement. means 51 calculates out and stores as separate data of consumed ink amount the number of ink droplets ejected from each of the print heads 17, 18.

When the control means 46 detects, during the printing operation, a status where the printing operation is stopped forcibly by a carriage returning, a feeding of next paper, or a print stop instruction by a user, the control means writes data representing the consumed ink amount calculated by and stored in the residual ink amount detection and judgement means 51 in the semiconductor storage means 27, 32 of the ink cartridges 1, 2, respectively. Owing to the operation, a print stopping time is not required by the data writing process. Further, data can be stored frequently in the semiconductor storage means 27, 32 of the ink cartridges 1, 2, respectively, at a stage when a certain amount of ink has been used.

When a predetermined time has passed during a printing operation, the control means 46 operates the carriage 11 to move to a position where a flushing operation takes place for the print heads 17, 18. After that, the print/flushing control means 49 activates the head drive means 50 which outputs drive signals to the print heads 17, 18 to thereby eject ink droplets for a certain number from all the nozzle apertures of the print heads.

Owing to the flushing operation, ink the viscosity of which has been increased near the nozzle apertures of each of the print heads 17, 18 are flushed, and the undesirable clogging can be precluded. The number of ink droplets exhausted by the flushing operation are calculated out as consumed ink data by the residual ink amount detection and judgement means 51. During the flushing operation, the control means 46 stores the consumed ink data generated by the flushing operation now proceeding in each of the semiconductor storage means 27, 32 attached to the ink cartridges 1, 2.

The printing operation proceeds further while processing 5 the operations as described above. If a clogging that previously occurred cannot be recovered, even by the flushing operations and white dot phenomena, the user may operate cleaning instruction switches 7, 8 on the panel 4. The white dot phenomena occurs when no ink is ejected from certain nozzle apertures and causes white streaks to continuously appear in printed text or pictures. By operating the cleaning instruction switches 7, 8, the control means 46 operates the print heads 17, 18 on the carriage 11 to the position where the print heads are capped and ink is sucked out of all the nozzle apertures of the print heads 17, 18 by driving the pumps 23*a*, 23*b*.

In the cleaning operation, negative pressure is applied to the nozzle apertures of the print heads 17, 18 thereby to forcibly exhaust ink in the print heads toward the caps 20, 21, respectively. The amount of ink consumed by the cleaning operation is calculated out as consumed ink data by the residual ink amount detection and judgement means 51. Then, the control means 46 stores, during the cleaning operation, the consumed ink data calculated by the means 51 in the semiconductor storage means 27, 32 of the ink cartridges 1, 2, respectively.

When the printing operation is finished and the power switch 5 is turned off, the control means 46 receives an output signal of a power shut-off detection and judgement means 52. Subsequently, the control means 46 operates the carriage motor control means 45 to move the carriage 11 to the capping position where the print heads 17, 18 are sealed by the caps 20, 21, respectively. After that, the control means 46 outputs to and writes in the semiconductor storage means 27, 34 of the ink cartridges 1, 2, respectively, various kinds of data stored in a working memory 53 such as date/time code representing when the ink cartridge was mounted on the printing apparatus, consumed ink amount, print quantity, the number of cleaning times, frequency of cleaning.

After the power shut-off detection and judgement means 52 confirms that all the required data is written in the semiconductor storage means 27, 32 of the ink cartridge, respectively, the means 52 stops supplying power to the entire printing apparatus.

When the power switch 5 is operated to supply power to the printing apparatus, the control means 46 proceeds with an initialize process including, for example, a cleaning operation for the print heads 17, 18 and a positioning operation for the carriage 11. At the same time, data representing the consumed ink amount, which is stored in the residual ink amount detection and judgement means 51 before the last power shut-off, is written in each of the semiconductor storage means 27, 32 of the ink cartridges 1, 2, respectively. After that, a printing operation is carried out in accordance with a print signal input to the printing apparatus, and required data such as consumed ink amount and the like is written frequently in the semiconductor storage means 27, 32 only at a time when the printing apparatus is in non-printing status as described above.

Figure 6:
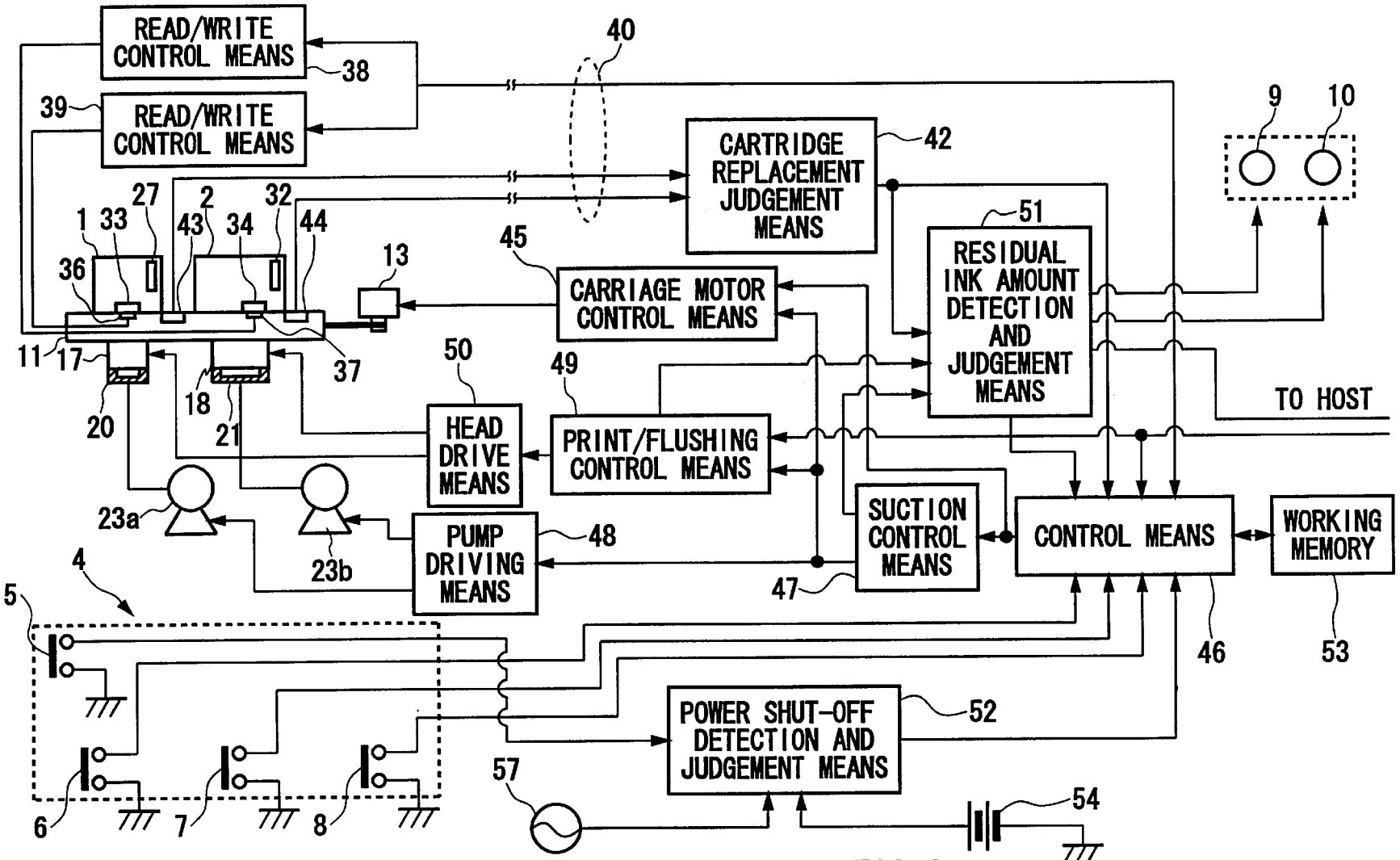
FIG. 6 is a block diagram showing a second embodiment of the control apparatus according to the present invention.

FIG. 6 is a block diagram showing a second embodiment of the control apparatus 41 according to the present invention. In the drawing, like parts and components are designated by the same reference numerals as the FIG. 5 embodiment, and the description will be omitted to avoid redundancy.

The only difference in the second embodiment shown in FIG. 6 from the first embodiment in FIG. 5 is to provide an auxiliary battery 54 which connects to the power shut-off detection and judgement means 52. While the printing apparatus is operating, if an accident happens such as, for example, an inevitable blackout or when power socket of the printing apparatus is accidentally pulled out of the outlet by entangling user's or other person's feet in the power line, the auxiliary battery 54 supplies power to the entire printing apparatus. In this embodiment, the power shut-off detection and judgement means 52 is provided with a switching section for switching power from a commercial power source 57 to the auxiliary battery 54.

If such an accident happens and the power from the commercial power line is shut off suddenly, the power shut-off detection and judgement means 52 switches to the auxiliary battery 54. While the power is supplied to the printing apparatus from the auxiliary battery 54, a preset power shut-off process takes place and, then, the power shut-off detection and judgement means 52 stops supplying power from the auxiliary battery 54 to the entire printing apparatus. The preset power shut-off process includes an operation for transmitting data of the consumed ink amount calculated out by the residual ink amount detection and judgement means 51 to the semiconductor storage means 27, 32 of the ink cartridges 1, 2, respectively.

Thus, according to the second embodiment of the present invention, the current, most new data relating to ink such as the consumed ink amount is written in the memory device attached to the ink cartridge even if an unexpected accident happens. Accordingly, when the power switch is operated again and a power is supplied from the commercial power source 57 to return to the normal printing condition, the printing apparatus is able to read an accurate information relating to ink from the memory device of the ink cartridge. As a result, correct printing operation can always take place.

It is preferable to provide the auxiliary battery 54 in the printing apparatus body, and the auxiliary battery 54 may be charged by the commercial power source 57 during the normal operation of the printing apparatus. On the other hand, it may also be applicable to provide an external auxiliary battery which is detachably mounted on the printing apparatus, so that a user can make a choice which type of auxiliary battery may be used according to his or her preference.

A third embodiment of the present invention will now be described with reference to FIG. 7 through FIG. 13.

Figure 7:
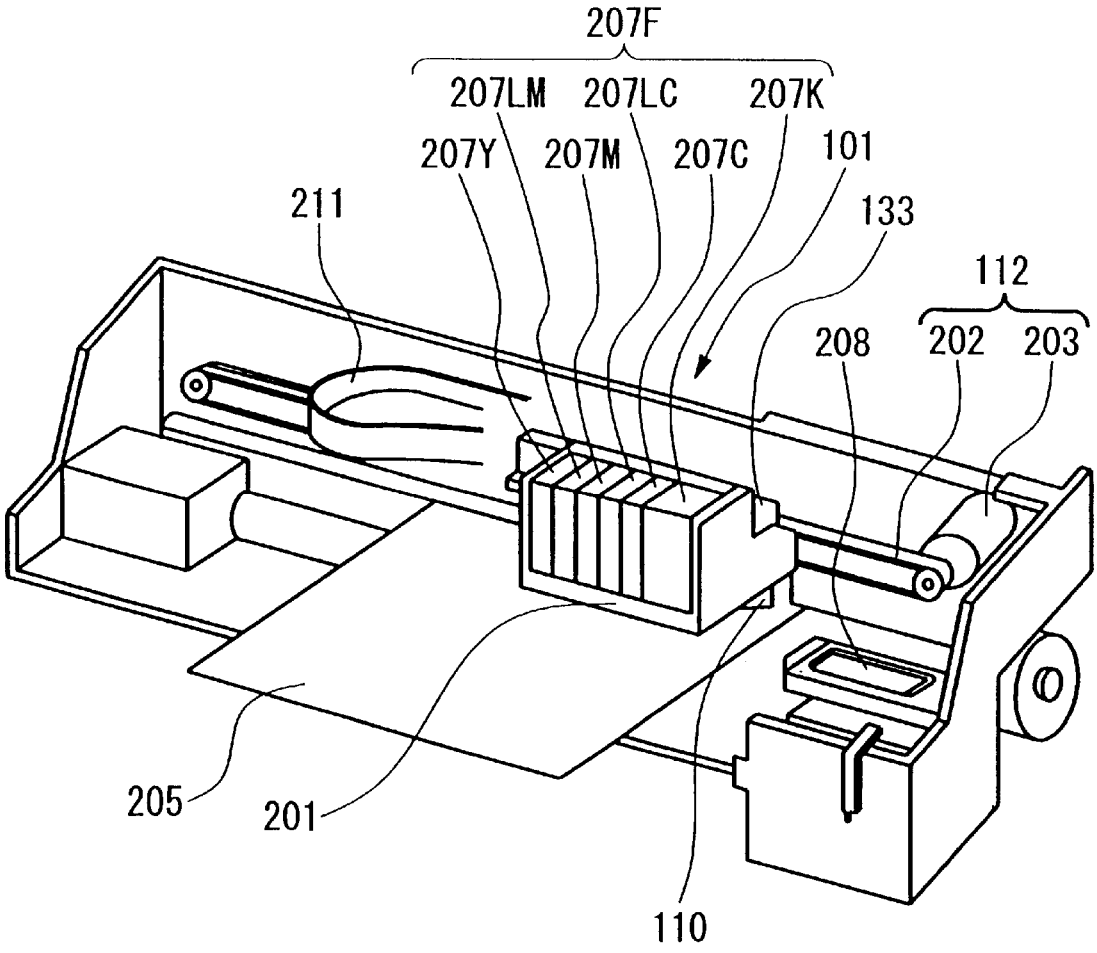
FIG. 7 is a schematic perspective view showing an essential part of the ink jet type printing apparatus to which the third embodiment of the present invention is applied.
Figure 8A:
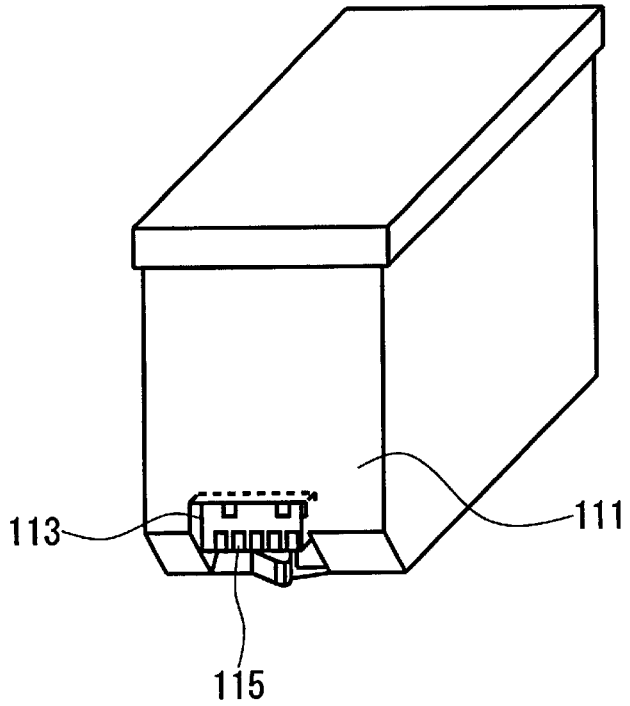
FIG. 8A is a perspective view of an ink cartridge which can be mounted on the printing apparatus shown in FIG. 7.
Figure 8B:
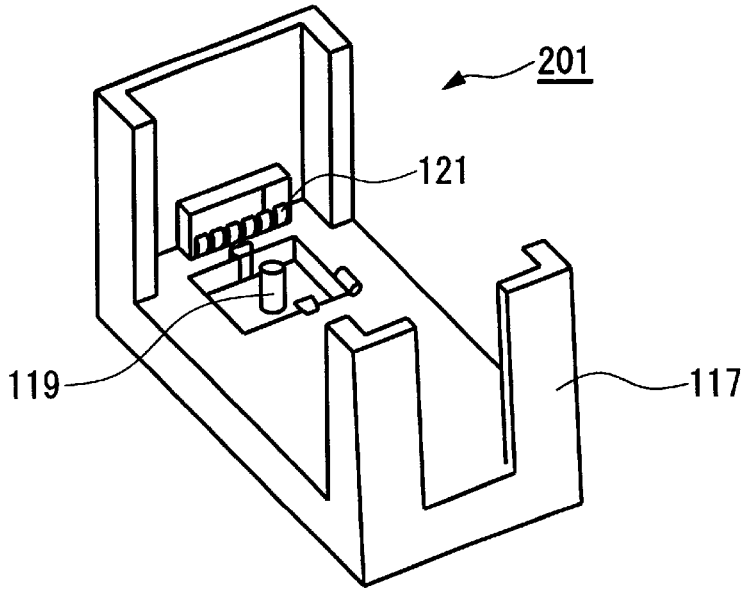
FIG. 8B is a perspective view of a cartridge holder on which the ink cartridge shown in FIG. 8A can be mounted.
Figure 9:
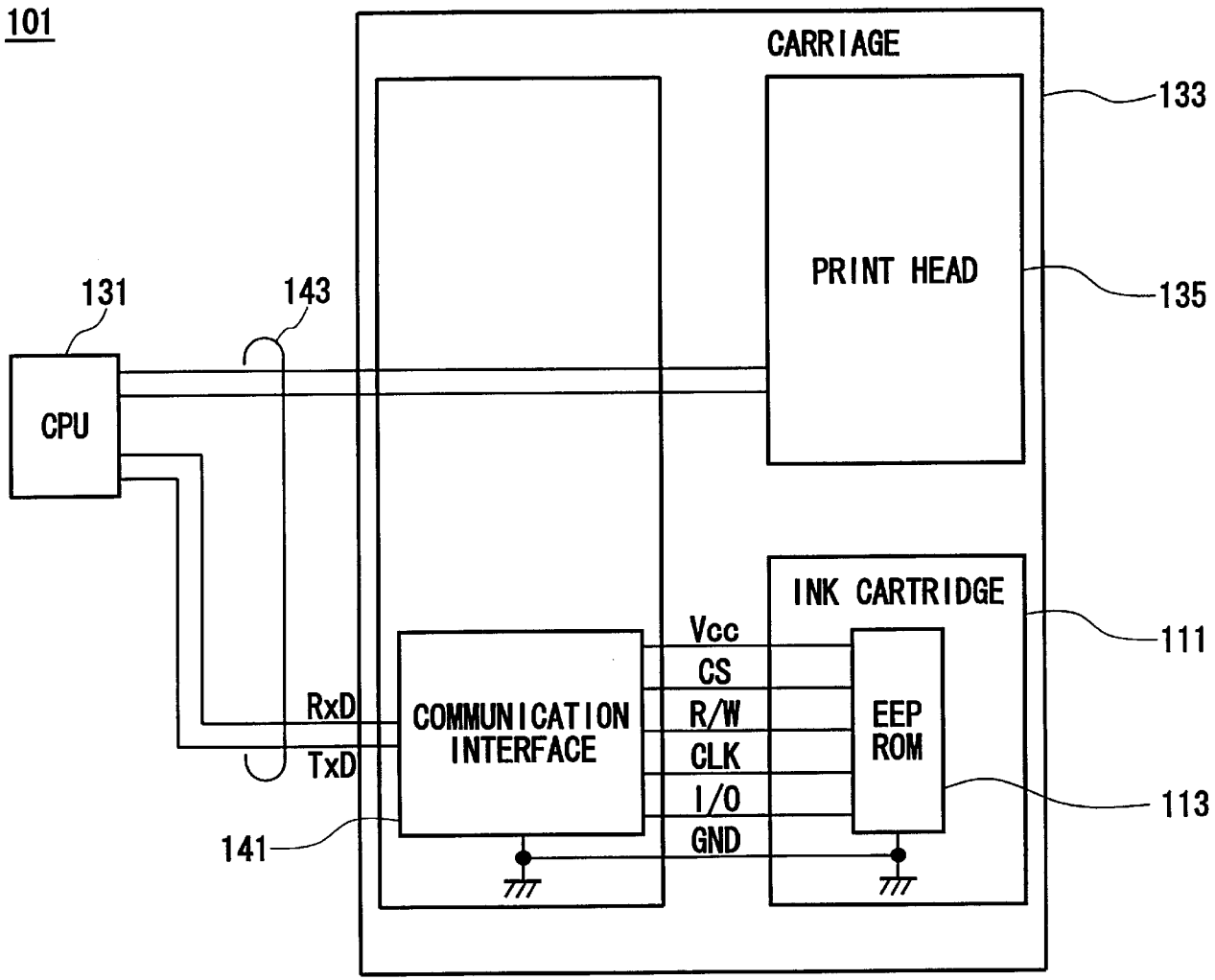
FIG. 9 is a block diagram showing an arrangement of a signal transmission between the printing apparatus and a central processing unit, or CPU according to the third embodiment of the present invention.
Figure 10:
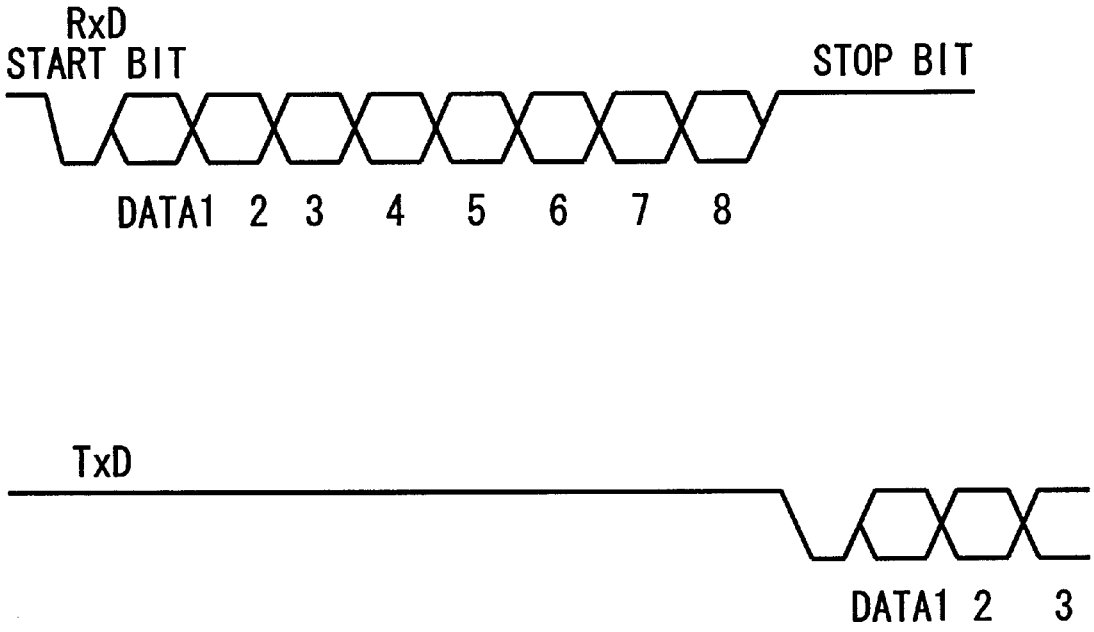
FIG. 10 shows bit signals of data transmitted between the CPU and a communication interface.
Figure 11:
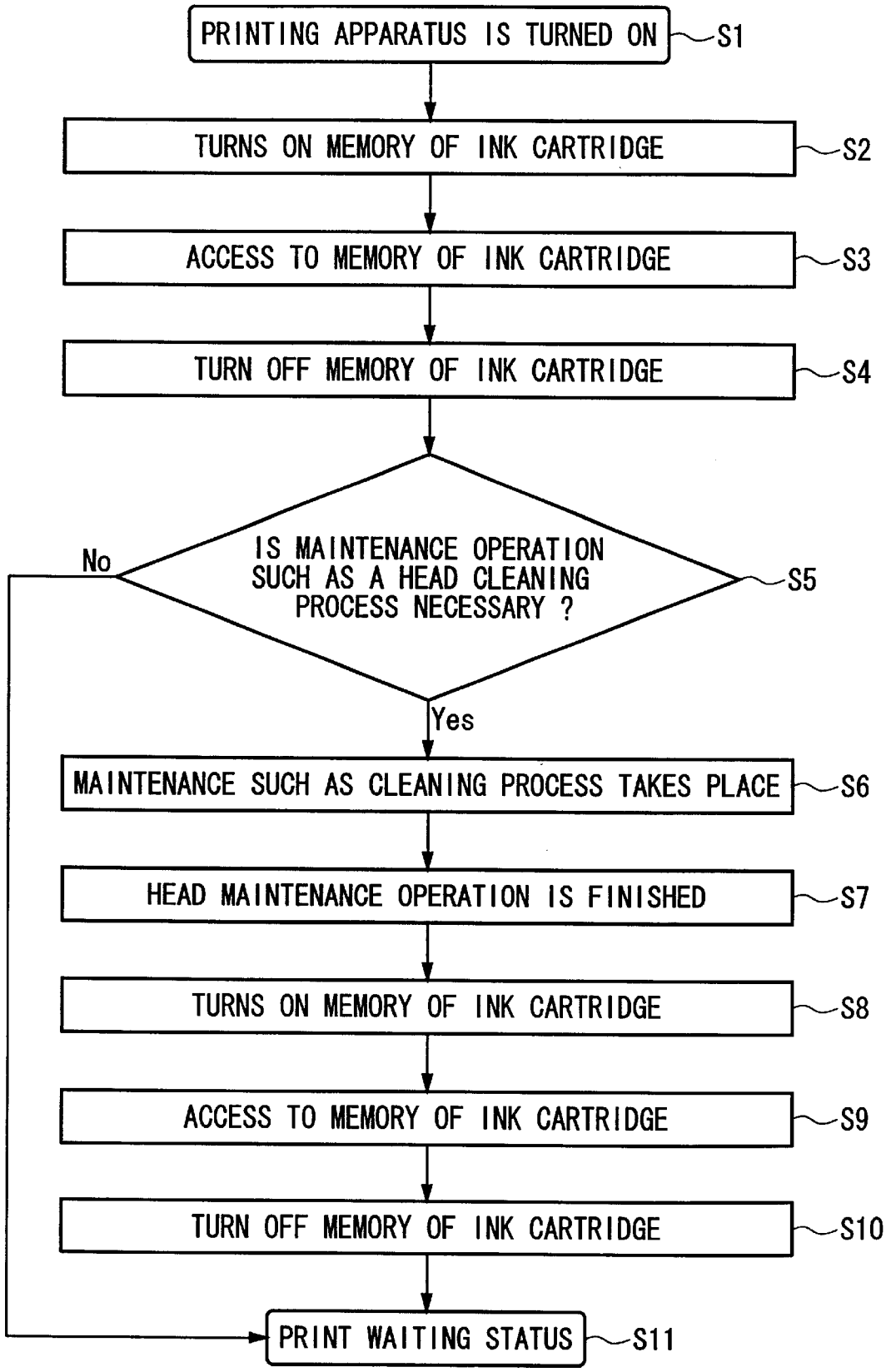
FIG. 11 is a flowchart showing a process flow proceeded by the CPU of the printing apparatus when a power is turned on according to the third embodiment of the present invention.
Figure 12:
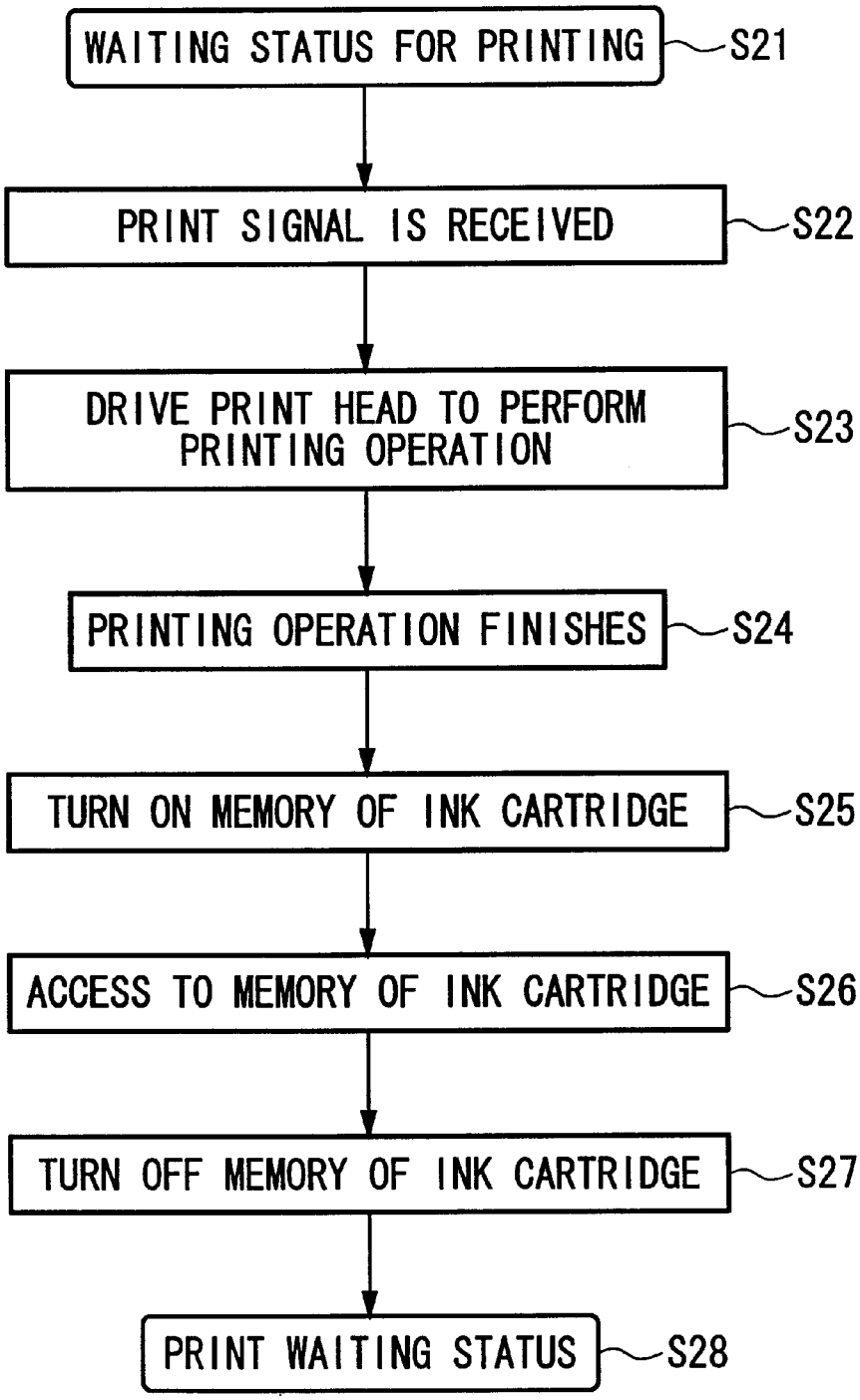
FIG. 12 is a flowchart showing a process flow proceeded by the CPU of the printing apparatus when a normal printing operation takes place according to the third embodiment of the present invention.
Figure 13:
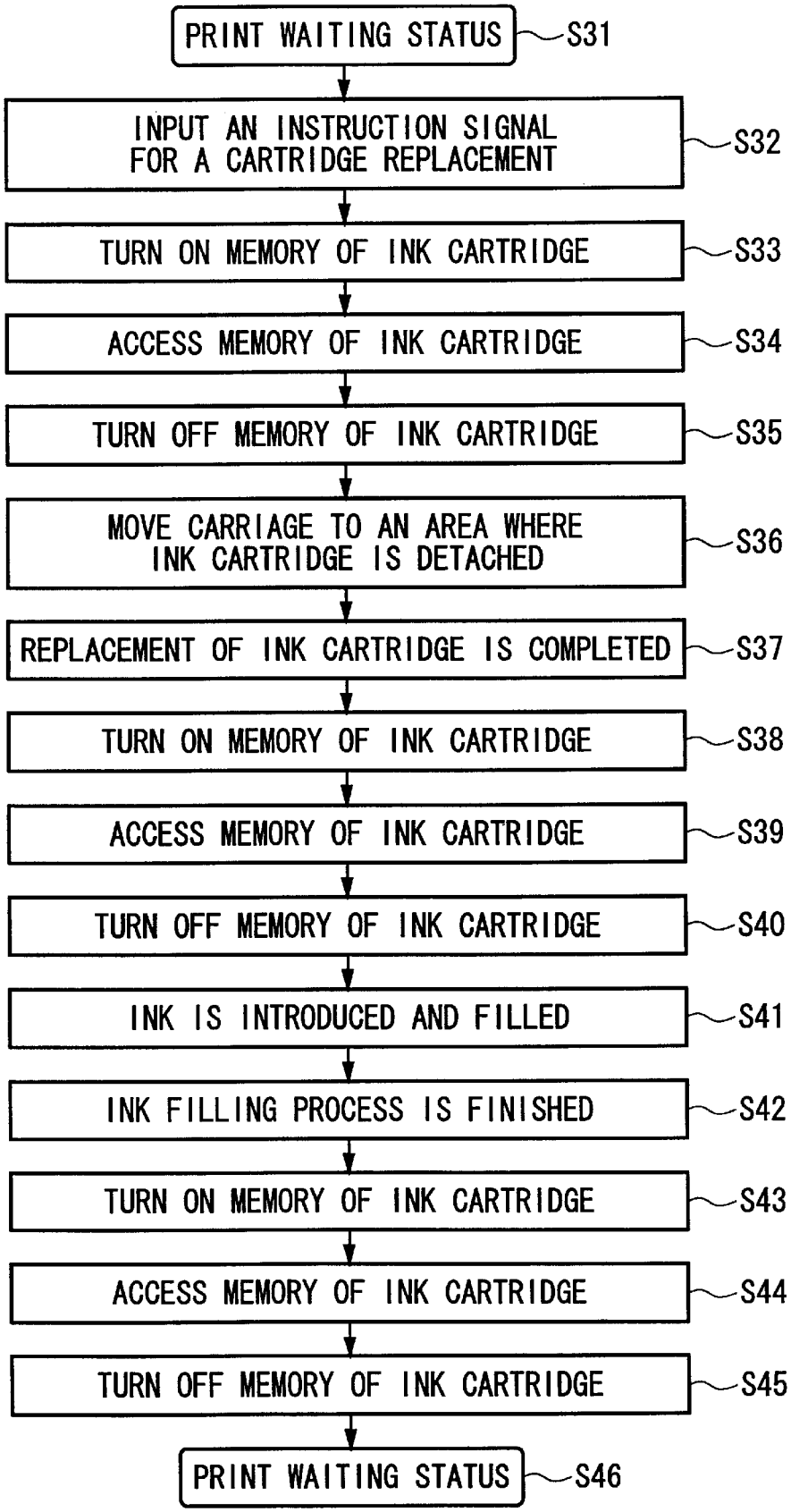
FIG. 13 is a flowchart showing a process flow proceeded by the CPU of the printing apparatus when an ink cartridge is replaced with new one according to the third embodiment of the present invention.

FIG. 7 is a schematic perspective view showing an essential part of the ink jet type printing apparatus to which the third embodiment of the present invention is applied. FIG. 8A is a perspective view of an ink cartridge which can be mounted on the printing apparatus shown in FIG. 7, and FIG. 8B is a perspective view of a cartridge holder on which the ink cartridge shown in FIG. 8A can be mounted. FIG. 9 is a block diagram showing an arrangement of a signal transmission between the printing apparatus and a central processing unit, or CPU according to the third embodiment of the present invention. FIG. 10 shows bit signals of data transmitted between the CPU and a communication interface. FIG. 11 is a flowchart showing a process flow proceeded by the CPU of the printing apparatus when a power is turned on according to the third embodiment of the present invention. FIG. 12 is a flowchart showing a process flow proceeded by the CPU of the printing apparatus when a normal printing operation takes place according to the third embodiment of the present invention. FIG. 13 is a flowchart showing a process flow proceeded by the CPU of the printing apparatus when an ink cartridge is replaced with new one according to the third embodiment of the present invention.

As shown in FIG. 7, an ink jet type printing apparatus 101 according to the third embodiment of the present invention is provided, as similar to the conventional apparatus, with an ink jet type print head 110 mounted on a carriage 133 which is reciprocated by a carriage mechanism 112 constituted by a carriage motor 203 and a transfer belt 202. While the carriage 133 reciprocates and scans on a print sheet 205, the print head 110 prints characters or images on a surface of the print sheet 205 while ink is supplied to the print head 110 from an ink cartridge 207F of an on-carriage type.

The ink cartridge 207F includes five color sub-cartridges 207Y, 207LM, 207M, 207LC and 207C containing therein color inks of yellow, light magenta, magenta, light cyan and cyan, respectively, and one black sub-cartridge 207K containing therein black ink. A cartridge holder 201 is secured to the carriage 133 on which the print head 110 is attached, and the ink cartridge 207F is mounted on the cartridge holder 201. The printing apparatus also includes a head maintenance mechanism 208 disposed at an end of the movable region of the print head 110 for performing an initial ink filling process, a cleaning process and a capping operation for preventing ink from drying.

A non-volatile rewritable memory device such as EEPROM described later is attached on the ink cartridge 207F, and the memory device electrically connects to a communication interface circuit (not shown) provided on the carriage 133 together with the print head 110. The interface circuit and the print head 110 electrically connect to a central processing unit, or CPU (not shown) of the printing apparatus through a movable flexible cable 211 so that a communication is established between the print head and the CPU.

FIG. 8A is a perspective view showing an ink cartridge according to the present invention and FIG. 8B is a perspective view of the cartridge holder 201 disposed on the carriage 133 of the ink jet type printing apparatus 101. In the drawing of FIG. 7, the ink cartridge 207 is of a single unit type in which a plurality of color are housed in separate ink chambers. However, the ink cartridge 111 shown in FIG. 8A is of a uni-color type, as an example, in order to simplify the following description.

The ink cartridge 111 accommodates therein a sponge-like porous member impregnating ink. On an outer surface of the ink cartridge 111 there is provided a non-volatile memory device such as, for example, an Electrically Erasable and Programmable Read Only Memory, or EEPROM 113, having accessing contacts 115 exposing outside. The cartridge holder 201, on the other hand, is constituted by a holding section 117 for holding the ink cartridge 111, an ink supply needle 119, and contact terminals 121 for contacting to the accessing contacts 115 of the EEPROM 113 of the ink cartridge 111. The ink supply needle 119 inserts in an ink supply port of the ink cartridge 111 and introduces ink therefrom to the print head 110 while the ink cartridge 111 is mounted on the holder section 117 of the cartridge holder 201.

FIG. 9 is a block diagram showing an arrangement of a signal transmission between the printing apparatus and a central processing unit, or CPU according to the third embodiment of the present invention.

As shown in FIG. 9, the printing apparatus 101 has a CPU 131 for controlling the apparatus and the carriage 133 for reciprocating the print head 135. As described above, on the carriage 133, there are provided the print head 135 and the cartridge holder 201 shown in FIG. 8B on which the ink cartridge 111 having the EEPROM 113 shown in FIG. 8A is mounted. In addition, a communication interface circuit 141 is mounted on the carriage 133 for enabling the CPU 131 to access the EEPROM 113.

As shown in FIG. 8, the EEPROM 113 serving as the memory device is disposed, merely as one example, at a corner part of the ink cartridge 111 defined by a bottom wall and a side wall thereof. However, the present invention is not limited thereto or thereby. For example, the EEPROM 113 may be attached on any one of a bottom wall, side wall, front wall or top wall of the ink cartridge ll if desired. In this case, of course the contact terminals 121 of the cartridge holder 201 should be arranged appropriately at a place enabling contact with the accessing contacts 115 of the EEPROM 113.

The flexible signal cable 143 allows the CPU 131 to communicate with the print head 135 on the carriage 133 and the communication interface circuit 151 without blocking the movement of the carriage 133. As shown in FIG. 9, the CPU 131 and the communication interface 141 are connected to each other by, for example, a signal receiving line R×D and a signal transmitting line T×D. On the other hand, the communication interface 141 and the EEPROM 113 are connected to each other by, for example, a power source line Vcc, a chip selection line CS, a read/write selection line R/W, a clock line CLK, an input/output data line I/O and a ground line GND.

The CPU 131 outputs drive pulse signals to the print head 135 to drive same when the printing operation or flushing operation takes place. During such time, that is, while the print head 135 is driven, according to the present invention, the CPU 131 turns off the power to the EEPROM 113 and no data is written in or read out from the EEPROM 113. However, only while the print head 135 is not driven, the CPU 131 selectively turns on the power to the EEPROM 113 and writes data in or reads data from the memory. Turning on or off the power to the EEPROM 113 is accomplished by supplying or not supplying a voltage through the power source line Vcc.

FIG. 10 shows an example of bit signals of data transmitted between the CPU and the communication interface when data is written in and read out from the EEPROM 113. As shown in the drawing, data is transmitted as data unit consisting of eight bit defined by a start bit of low level and a stop bit of high level on the signal receiving line RxD and the signal transmitting line T×D.

After finishing the writing data in the EEPROM 113, the CPU 131 turns off the power to the EEPROM 113. As described above, the EEPROM 113 is turned on only within time periods in which the print head 135 is not driven and the data is required to be written in or read out from the EEPROM 113. In other words, the EEPROM 113 is normally turned off only except the time period mentioned above.

Timings when data is written in or read out from the EEPROM 113 includes, for example, immediately after power-on the printing apparatus, immediately before power-off the printing apparatus, before and after ink cartridge is replaced with new one, after one page of sheet finishes being printed, immediately after finishing cleaning operation for print head, and the like.

Thus, while the print head 135 is driven, no access to the EEPROM 113 is performed and, in addition, the power to the EEPROM 113 is turned off. Accordingly, there is no possibility to change or give damage data to or from the EEPROM 113 due to the drive pulse signals to the print head.

Next, process flows by the CPU 131 of the printing apparatus according to the present invention will now be described with reference to FIGS. 11 through 13.

First, the operation of the printing apparatus when the power is turned on will be described with reference to a flowchart shown in FIG. 11.

After a power to the printing apparatus is turned on (S1) the CPU 131 turns on a power to the EEPROM 113 of the ink cartridge 111 (S2), reads out data stored in the EEPROM 113 (S3) and, after finishing the writing operation, turns off the power to the EEPROM 113 (S4). Data stored in the EEPROM 113 includes information relating ink, for example, date of manufacturing ink, residual ink, date/time code of when the ink cartridge is unpacked and the like. According to information, the CPU 131 judges if the ink cartridge 111 mounted on the printing apparatus is allowed to be used.

Next, the CPU 131 judges if a maintenance operation such as a head cleaning process is necessary (S5). If the CPU 131 judges that no maintenance operation is necessary (S5, NO), the printing apparatus goes on to a waiting status for printing (S11). On the other hand, if the CPU 131 judges that the head maintenance operation is needed, the operation such as the cleaning process takes place (S6). The head maintenance operation is necessary when, for example, a certain time period has passed since the last time the printing apparatus was used. In the head maintenance operation includes a flushing process in which the print head 135 is driven so that ink droplets are forcibly ejected from all the nozzle apertures of the print head. During such process, data in the EEPROM 113 is never deformed or damaged by the noise signal generating from the head drive pulse signals because the power to the EEPROM 113 has been shut off at the step S4.

At step S4, if the CPU 131 finds that the residual ink in the ink cartridge 111 according to data read out from the EEPROM 113 is too little to perform a head maintenance operation, no operation takes place even if the certain time period has passed since the last time the printing apparatus was used.

Next, when the head maintenance operation is finished (S7), the CPU turns on the power to the EEPROM 113 attached on the ink cartridge 111 (S8), and reads and writes data from and in the EEPROM 113 (S9). For example, the CPU 131 calculates out a new residual ink amount on the bases of the ink amount consumed by the head maintenance operation and, then, the CPU writes as a new data the residual ink amount in the EEPROM 113. When the data writing operation is finished, the CPU 131 turns off the power to the EEPROM 113 (S10), and the printing apparatus comes to a print waiting status.

Next, a printing operation by the CPU 131 will be described with reference to a flow chart shown in FIG. 12.

During the waiting status for printing (S21), when the CPU 131 receives a print signal from the host apparatus not shown (S22), the CPU 131 depicts a print image from the print data and drives the print head 135 to print the print image on a printing medium (S23). During the printing operation, because power is not supplied to the EEPROM 113 of the ink cartridge 111 and, therefore, no access to the EEPROM 113 is performed, absolutely no damage or influence is given to data contained in the EEPROM 113 due to noise generated by the drive signal to the print head.

When the printing operation finishes (S24), the CPU 131 turns on a power to the EEPROM 113 of the ink cartridge 111 (S25) and, then, reads data from or writes data in the EEPROM 113 according to a preset program (S26). For example, the CPU 131 calculates out a residual amount of ink according to the amount of ink consumed during the last printing operation, and writes the residual amount of ink in the EEPROM 113. More specifically, the consumed ink amount is calculated by multiplying the number of dots ejected for printing by the ink quantity of each dot, and the resulted figure is subtracted from the residual ink, so that the residual ink amount can be calculated. The calculation is actually made under a condition where a certain dot number of a preset ink amount is regarded as a unit. After finishing the data reading/writing operation with respect to the EEPROM 113, the CPU 131 turns off the power to the EEPROM 113 (S27), and the printing apparatus proceeds to a print waiting status (S28).

Next, a process by the CPU 131 when the ink cartridge 111 is replaced will be described with reference to FIG. 13.

During a print waiting status (S31), when an instruction signal for a cartridge replacement is input (S32), the CPU 131 turns on a power to the EEPROM 113 attached on the ink cartridge 111 (S33) and, then, accesses the EEPROM 113 for a preset data read/write operation (S34). For example, the CPU 131 writes in the EEPROM 113 data representing, for example, a residual ink amount immediately before the replacement of the ink cartridge 111, a time duration when the ink cartridge has been mounted on the printing apparatus and the like. After finishing the data read/write operation, the CPU 131 turns off the power to the EEPROM 113 (S35).

Subsequently, the CPU 131 moves the carriage 133 to an area where the ink cartridge is detached from the printing apparatus (S36). The user removes the ink cartridge, which has been used for printing to date, from the carriage 133 for the replacement, and mounts a new ink cartridge on the carriage 131. When the replacement of the ink cartridge is completed, and a signal representing the completion of the cartridge replacement is input (S37), the CPU 131 turns on a power to the EEPROM 113 attached on the new ink cartridge 111 (S38) and, then, accesses the EEPROM 113 to read and/or write data (S39). In the step of S39, data includes, for example, the manufacturing date of the new ink cartridge 111, the type or kind of the ink cartridge and the like, so that the CPU 131 judges whether or not the newly installed ink cartridge is appropriate for printing. At the same time, the CPU 131 writes data representing a date when the new ink cartridge is unpacked in the EEPROM 113 of the newly installed ink cartridge. After finishing those read/write operation, the CPU 131 turns off the power to the EEPROM 113 (S40).

Subsequently, the CPU 131 moves the carriage 133 to, for example, a home position outside the printing area where ink is introduced from the newly installed ink cartridge 111 and fills the print head 135 (S41). In this operation, flushing operations take place several times. Because the power to the EEPROM 113 is shut off during the flushing operations, there is no possibility that noise generating from the head drive signals would give damage or deform data stored in the EEPROM 113.

When the ink filling process is finished (S42), the CPU 131 turns on again the power to the EEPROM 113 of the ink cartridge 111 (S43) and accesses the EEPROM 113 to perform a data read/write operation (S44). For example, the CPU 131 calculates out a new residual ink amount in accordance with the calculated ink consumption amount during the ink filling process, and writes data in the EEPROM 113. After finishing the data read/write operation, the CPU 131 turns off the power to the EEPROM 113 of the ink cartridge 111 (S45) and, then, the printing apparatus proceeds to a print waiting status (S46).

The embodiments as described above are merely some examples for explaining the concept of the present invention. The present invention, however, is not limited thereto or thereby. Many other different examples or modifications may be applicable if desired without exceeding the scope of the subject matter of the present invention.

For example, each of the embodiments described above concerns an on-carriage type printing apparatus in which the ink cartridges are mounted on a moving carriage. Generally, according to the on-carriage type printing apparatus, a print head is disposed adjacent to a memory device attached on the ink cartridge. Because of such arrangement, the memory device is readily affected by noise. However, according to the present invention as described above, the memory device is accessible only when no drive signal is supplied to the print head. Therefore, no problem in noise would be raised even in the on-carriage type printing apparatus. Further, by turning off a power to the print head during the printing operation, the noise problem can be eliminated perfectly. The present invention may also be applicable, of course, to an off-carriage type printing apparatus in which ink cartridge is mounted at a fixed part of the printing apparatus apart from a moving carriage, and ink is supplied to the print head disposed on the carriage by a flexible ink supply tube, and the throughput of the print speed is not deteriorated.

Further, because the problem with respect to the throughput can be eliminated according to the present invention as data is written in the memory device only during non-printing operation, the printing apparatus may employ various types of memory devices which require a relatively long time for data read/write operation. For example, non-contact type memory device such as magnetic memory device, opto-magnetic memory device, electro-magnetic memory device may be used in accordance with desired utility.

As described above, according to the present invention, since the non-printing status of the print head is detected and information relating to ink such as residual ink amount is stored in a semiconductor storage means serving as a memory device of the ink cartridge, the most current information can be stored without lowering the throughput of the print speed of the printing apparatus. Therefore, the judgement of the residual ink amount can be made with high reliability.

Further, information relating to ink can be assuredly stored in the memory device of the ink cartridge even if the power to the printing apparatus is suddenly shut off due to user's error or unexpected accident or happening.

Moreover, according to the present invention, because the power to the memory device is turned on immediately before accessing the memory device and it is turned off immediately after the access, the memory device can be assuredly protected from noise generated by driving the print head. Therefore, data contained in the memory device is not affected by the noise.

Still further, because the problem with respect to the throughput can be eliminated according to the present invention as data is written in the memory device only during non-printing operation, the printing apparatus may employ various types of memory devices which require a relatively long time for data read/write operation. For example, non-contact type memory device such as magnetic memory device, opto-magnetic memory device, electromagnetic memory device may be used in accordance with desired utility.

Furthermore, because data is written in the memory device only during non-printing status of the printing apparatus, no noise problem due to the head drive signal is raised. This is advantageous particularly with the on-carriage type printing apparatus.

What is claimed is:

1. An ink jet type printing apparatus, comprising:

a carriage;

a print head having nozzle apertures from which ink droplets eject;

an ink cartridge containing ink to be supplied to said print head, wherein said ink cartridge is an on-carriage type ink cartridge that is disposed on said carriage;

a memory device attached to said ink cartridge, said memory device storing information relating to ink contained in said ink cartridge; and an access control device for controlling accesses to said memory device for reading data from and writing data in said memory device, said access control device allowing the access to said memory device only when both the carriage and the print head are not driven.

2. The ink jet type printing apparatus according to claim 1, wherein both the carriage and the print head are not driven by a power off instruction signal operated by a user.

3. The ink jet type printing apparatus according to claim 1, wherein both the carriage and the print head are not driven by forcibly shutting down the printing operation.

4. The ink jet type printing apparatus according to claim 1, wherein both the carriage and the print head are not driven by accidentally, or inevitably shutting off a power.

5. The ink jet type printing apparatus according to claim 4, further comprising an auxiliary battery for supplying power to the apparatus when the accidental or inevitable power shut-off occurs.

6. The ink jet type printing apparatus according to claim 1, wherein said memory device comprises a contact type non-volatile memory.

7. The ink jet type printing apparatus according to claim 1, wherein said memory device comprises a non-contact type non-volatile rewritable memory.

8. The ink jet type printing apparatus according to claim 1, wherein said access control device accesses the memory device only when said print head is not driven.

9. The ink jet type printing apparatus according to claim 1, wherein said memory device comprises an electrically rewritable semiconductor storage device.

10. The ink jet type printing apparatus according to claim 1, wherein said memory device is turned off when said print head is driven to perform a printing operation.

11. The ink jet type printing apparatus according to claim 1, wherein said ink cartridge comprises a first ink cartridge member containing black ink and a second ink cartridge for containing a plurality of different color inks, and said memory device comprises a first memory device for said first, black ink cartridge and a second memory device for said second, color ink cartridge.

12. The ink jet type printing apparatus according to claim 1, wherein said access control device comprises:

a read/write section for reading data from and writing data in said memory device;

a residual ink amount detection and judgment section for calculating out an ink amount consumed by said print head; and a control section for operating said read/write section to perform a read/write operation, when both the carriage and the print head are not driven, in accordance with information relating to calculated residual ink receiving from said residual ink amount detection and judgment section.

13. The ink jet type printing apparatus according to claim 1, wherein said access control device counts a number of times that data has been written to the memory device.

14. The ink jet type printing apparatus according to claim 1, wherein said memory device is disposed on said ink cartridge at a position adjacent to said print head.

15. A method of accessing a memory device attached to an ink cartridge for storing information relating to ink for use in an ink jet type printing apparatus having a print head, wherein said ink cartridge is an on-carriage type ink cartridge that is disposed on a carriage and wherein the method comprises:

writing information to the memory device only when both said print head and said carriage are not driven; and reading information from the memory device only when both said print head and said carriage are not driven.

16. The memory device accessing method according to claim 15, wherein information is read from or written in the memory device after a power off instruction signal is input and before actually turning off a power to the printing apparatus.

17. The memory device accessing method according to claim 15, wherein information is read from or written in the memory device after a printing operation is forcibly shut down.

18. The memory device accessing method according to claim 15, wherein information is read from or written in the memory device after a power to the printing apparatus is accidentally, inevitably shut down and before the power is actually turned off.

19. The memory device accessing method according to claim 18, wherein the power to the printing apparatus is supplied from an auxiliary battery after the power is actually turned off.

20. A method of controlling an ink jet type printing apparatus having a print head and an ink cartridge provided with a memory device for storing information relating to ink, comprising steps of:

turning on a power to the printing apparatus;

accessing the memory device provided on said ink cartridge and reading out information stored therein only when both said ink cartridge and said print head are not driven;

judging whether a head maintenance operation is necessary;

proceeding the head maintenance operation if it is judged to be necessary; and accessing the memory device and writing new information therein only when both said ink cartridge and said print head are not driven.

21. The control method according to claim 20, further comprising steps of:

turning on a power to the memory device immediately before said step of accessing the memory device and reading out information; and turning off the power to the memory device immediately after said step of accessing the memory device and writing new information.

22. A method of controlling an ink jet type printing apparatus having a print head and an ink cartridge provided with a memory device for storing information relating to ink, comprising steps of:

inputting an instruction to replace the ink cartridge;

accessing the memory device of the ink cartridge and writing information in the memory device, wherein the memory device is accessed and information is written thereto in response to said instruction being input and before said memory device is replaced;

moving a carriage on which the print head is mounted to a position where the ink cartridge is to be replaced;

replacing the ink cartridge;

accessing the memory device of an ink cartridge newly installed in the printing apparatus;

introducing ink contained in the new ink cartridge to the print head;

finishing the ink introduction; and accessing the memory device.

23. The control method according to claim 22, further comprising steps of:

turning on a power to the memory device immediately before each of said steps of accessing the memory device; and turning off the power to the memory device immediately after each of said steps of accessing the memory device.

* * * * *